US011363918B2

(12) United States Patent
Elfstrom et al.

(10) Patent No.: US 11,363,918 B2
(45) Date of Patent: Jun. 21, 2022

(54) DISPENSER FOR SHEET PRODUCTS AND OPERATING METHOD

(71) Applicant: Essity Hygiene and Health Aktiebolag, Gothenburg (SE)

(72) Inventors: Boris Allan Elfstrom, Philadelphia, PA (US); Jason Zerweck, Philadelphia, PA (US); Kevin Murphy, Philadelphia, PA (US)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 16/474,153

(22) PCT Filed: Jan. 9, 2017

(86) PCT No.: PCT/EP2017/050358
§ 371 (c)(1),
(2) Date: Jun. 27, 2019

(87) PCT Pub. No.: WO2018/127301
PCT Pub. Date: Jul. 12, 2018

(65) Prior Publication Data

US 2019/0335961 A1 Nov. 7, 2019

(51) Int. Cl.
*A47K 10/36* (2006.01)
*A47K 10/44* (2006.01)
*G07B 3/04* (2006.01)

(52) U.S. Cl.
CPC ..... *A47K 10/3625* (2013.01); *A47K 10/44* (2013.01); *G07B 3/04* (2013.01)

(58) Field of Classification Search
CPC ..... A47K 10/3625; A47K 10/44; G07B 3/04
(Continued)

(56) References Cited

U.S. PATENT DOCUMENTS 2,542,067 A * 2/1951 Waite ..... G07F 13/10 221/104
3,777,931 A 12/1973 Fleming
(Continued)

FOREIGN PATENT DOCUMENTS

CN 101080188 A 11/2007
CN 100518611 C 7/2009
(Continued)

OTHER PUBLICATIONS

Australian Government, IP Australia, Examination Report No. 1 for Standard Patent Application, Application No. 2017390353, dated Dec. 10, 2019 (3 pages).
(Continued)

*Primary Examiner* — Rakesh Kumar
(74) *Attorney, Agent, or Firm* — Cantor Colburn LLP

(57) ABSTRACT

A dispenser for sheet products includes a housing having a space inside for accommodating a stack of sheet products, wherein the housing includes a dispensing opening for dispensing a sheet product from the front of the stack, and an electronic controller configured to receive a pull-out signal indicating the removal of a product from the front of the stack through the dispensing opening and, upon receiving said pull-out signal, to send out a drive signal to transfer a number of sheet products from the front of the stack into a presentation position. The controller is further configured to receive a low-level signal indicating that the amount of sheet products left within the housing has been reduced to below a predetermined level and, upon receiving said low-level signal, to enter into a low-level mode in which the sending of the drive signal in response to the pull-out signal is disabled.

20 Claims, 8 Drawing Sheets

(58) Field of Classification Search
USPC ..... 221/1
See application file for complete search history.

(56) References Cited

U.S. PATENT DOCUMENTS

| | | | | |
|---|---|---|---|---|
| 4,311,252 | A | 1/1982 | Hope, Jr. et al. | |
| 4,717,043 | A * | 1/1988 | Groover | G07B 3/04 221/7 |
| 4,838,454 | A | 6/1989 | Salzmann et al. | |
| 4,938,382 | A | 7/1990 | Frazier et al. | |
| 4,953,747 | A | 9/1990 | Wenkman et al. | |
| 5,025,139 | A * | 6/1991 | Halliburton, Jr. | G07D 7/12 235/379 |
| 5,076,466 | A | 12/1991 | Petterson et al. | |
| 5,083,765 | A * | 1/1992 | Kringel | B65H 1/025 271/118 |
| 5,097,981 | A * | 3/1992 | Degasperi | G09F 27/00 221/6 |
| 5,207,349 | A * | 5/1993 | Kringel | B65H 1/025 221/15 |
| 5,238,143 | A * | 8/1993 | Crighton | B65H 3/042 221/1 |
| 5,413,325 | A * | 5/1995 | Dubois | B65H 3/5238 271/225 |
| 6,257,443 | B1 | 7/2001 | LaCount | |
| 6,874,612 | B1 * | 4/2005 | Uland | G07B 3/04 186/52 |
| 7,677,410 | B2 * | 3/2010 | Lee | A47K 10/425 221/258 |
| 8,443,988 | B2 * | 5/2013 | Niederhuefner | G08B 13/14 211/183 |
| 8,823,521 | B2 * | 9/2014 | Overhultz | G07F 9/026 340/568.1 |
| 8,941,495 | B2 * | 1/2015 | Wiese | G08B 13/08 340/568.8 |
| 9,167,914 | B2 * | 10/2015 | Rankin, VI | A47F 11/10 |
| 9,576,417 | B2 * | 2/2017 | Christianson | G07F 9/026 |
| 9,604,811 | B2 * | 3/2017 | Case | G07F 11/045 |
| 9,805,334 | B2 * | 10/2017 | Overhultz | A47F 1/126 |
| 10,271,666 | B2 * | 4/2019 | Taylor | A47F 1/125 |
| 10,602,890 | B2 * | 3/2020 | Billman | A47K 10/422 |
| 2002/0033405 | A1 * | 3/2002 | Gergek | A47K 10/3618 225/96 |
| 2002/0074340 | A1 | 6/2002 | Phelps | |
| 2003/0019880 | A1 | 1/2003 | Timmers et al. | |
| 2005/0168345 | A1 * | 8/2005 | Swafford | G08B 13/19697 340/686.1 |
| 2007/0034638 | A1 | 2/2007 | Zeiron | |
| 2007/0194166 | A1 * | 8/2007 | Reinsei | A47K 10/36 242/563 |
| 2007/0228066 | A1 * | 10/2007 | Almas | B65D 83/0858 221/211 |
| 2008/0033824 | A1 * | 2/2008 | Packes | G06Q 30/02 705/14.24 |
| 2008/0135570 | A1 * | 6/2008 | Lee | A47K 10/422 221/36 |
| 2010/0114366 | A1 * | 5/2010 | Case | A47K 10/427 700/232 |
| 2010/0268381 | A1 * | 10/2010 | Goerg | A47K 10/3662 700/244 |
| 2010/0286817 | A1 * | 11/2010 | Goeking | A47K 10/3612 700/231 |
| 2011/0133019 | A1 * | 6/2011 | Keily | A47K 10/34 242/564 |
| 2011/0215188 | A1 * | 9/2011 | Lalau | A47K 10/36 242/564.1 |
| 2012/0138625 | A1 | 6/2012 | Case et al. | |
| 2012/0318818 | A1 | 12/2012 | Kobayashi | |
| 2013/0048667 | A1 | 2/2013 | Wieser | |
| 2013/0221019 | A1 | 8/2013 | Rozek | |
| 2014/0319164 | A1 | 10/2014 | Wilson et al. | |
| 2014/0326745 | A1 | 11/2014 | Young et al. | |
| 2015/0090832 | A1 | 4/2015 | Case et al. | |
| 2015/0289730 | A1 * | 10/2015 | Keily | A47K 10/3625 242/562 |
| 2016/0090229 | A1 * | 3/2016 | Stenberg | B65D 85/62 428/189 |
| 2016/0374524 | A1 | 12/2016 | Stenberg et al. | |
| 2018/0351386 | A1 * | 12/2018 | Zosimadis | A47K 5/12 |
| 2019/0082898 | A1 * | 3/2019 | Ghazi | A47K 10/44 |
| 2019/0335961 | A1 * | 11/2019 | Elfstrom | A47K 10/3625 |
| 2019/0350414 | A1 * | 11/2019 | Starkey | A47K 10/3625 |
| 2019/0374074 | A1 * | 12/2019 | Larsson | A47K 10/44 |
| 2020/0015639 | A1 * | 1/2020 | Borke | A47K 10/3618 |
| 2020/0205621 | A1 * | 7/2020 | Osborne, Jr. | A47K 5/1217 |

FOREIGN PATENT DOCUMENTS

| | | | | |
|---|---|---|---|---|
| CN | 102171117 | A | 8/2011 | |
| CN | 105593149 | A | 5/2016 | |
| CN | 106231968 | A | 12/2016 | |
| CN | 109598843 | A | 4/2019 | |
| CO | 20160005700 | | 6/2017 | |
| EP | 0506243 | A1 | 9/1992 | |
| RU | 2572170 | C2 | 12/2015 | |
| SU | 1207968 | A1 | 1/1986 | |
| WO | 2006071148 | A1 | 7/2006 | |
| WO | 2009071148 | A1 | 6/2009 | |
| WO | 2010042675 | A1 | 4/2010 | |
| WO | 2012027346 | A2 | 3/2012 | |
| WO | 2014154282 | A1 | 10/2014 | |
| WO | 2014154284 | A1 | 10/2014 | |
| WO | 2014154285 | A1 | 10/2014 | |
| WO | 2015050863 | A1 | 4/2015 | |
| WO | WO-2015130569 | A1 * | 9/2015 | A47K 10/424 |
| WO | 2015163802 | A1 | 10/2015 | |
| WO | WO-2015163802 | A1 * | 10/2015 | A47K 10/32 |

OTHER PUBLICATIONS

New Zealand Intellectual Property Office, First Examination Report, Application No. 755177, dated Feb. 7, 2020 (2 pages).

European Patent Office, Partial International Search Report, International Application No. PCT/EP2017/050359, dated Sep. 14, 2017 (15 pages).

European Patent Office, International Search Report and Written Opinion of the International Searching Authority, International Application No. PCT/EP2017/050359, dated Jan. 3, 2018 (20 pages).

The Russian Federal Service for Intellectual Property, Office Action, Application No. 2019125202/12(049262), dated Dec. 16, 2019 (7 pages).

The Russian Federal Service for Intellectual Property, Office Action, Application No. 2019121432, dated Dec. 26, 2019 (7 pages).

Colombian Patent Office, Office Action 7960, Application No. NC2019/0007433, dated Aug. 4, 2020 (10 pages).

Federal Service for Intellectual Property, Decision To Grant, Russian Application No. 2019121432/12 (041886), dated Jul. 16, 2020, 12 pages.

Federal Service for Intellectual Property, Decision To Grant, Russian Application No. 2019125202/03 (049262), dated Jul. 13, 2020, 20 pages.

New Zealand Intellectual Property Office, Patent examination report 1, Application No. 755178, dated Jul. 13, 2020, 4 pages.

Colombian Patent Office, Office Action No. 8298, Application No. NC2019/0007442, dated Jul. 15, 2020, 20 pages.

Canadian Intellectual Property Office, Office Action, Application No. 3,048,754, dated Jul. 7, 2020, 4 pages.

European Patent Office, International Search Report and Written Opinion of the International Searching Authority, International Application No. PCT/EP2017/050358, dated Sep. 13, 2017 (13 pages).

The Russian Federal Service for Intellectual Property, Office Action issued in corresponding Russian Application No. 2019125200/20(049259), dated Apr. 13, 2020, including English translation, 15 pages.

(56) References Cited

OTHER PUBLICATIONS

IP Australia, Examination Report No. 1 for Standard Patent Application issued in corresponding Australian Patent Application No. 2017390354, dated May 29, 2020, 4 pages.
China National Intellectual Property Administration, Notification of the First Office Action (National Phase of PCT Application), Application No. 201780082625.9, dated Dec. 3, 2020 (17 pages).
Australian Government, IP Australia, Examination Report No. 2 for Standard Patent Application, Application No. 2017390354, dated Nov. 6, 2020 (5 pages).
China National Intellectual Property Administration (CNIPA) of the People's Republic of China, Notification of the First Office Action (National Phase of PCT Application), Application No. 201780082636.7, dated Dec. 22, 2020 (18 pages).
Colombian Patent Office, Office Action 704, Application No. NC2019/0007433, dated Jan. 25, 2021 (10 pages).
Colombian Patent Office, Office Action 8857, Application No. NC2019/0007433, dated Jun. 17, 2021 (11 pages).
Colombian Patent Office, Resolution No. 66661, Application No. NC2019/0007433, dated Oct. 13, 2021 (10 pages).
European Patent Office; Office Action; Application No. 17700210.2-1009; dated Feb. 21, 2022; 5 pages.

* cited by examiner

DISPENSER FOR SHEET PRODUCTS AND OPERATING METHOD

CROSS-REFERENCE TO RELATED APPLICATION

The present application is a national stage entry under 35 U.S.C. § 371 of, and claims priority to, International Application No. PCT/EP2017/050358, filed Jan. 9, 2017, the disclosure of which is hereby incorporated herein by reference in its entirety.

FIELD OF THE INVENTION

The present invention relates to a dispenser for dispensing sheet products from a stack of sheet products, and to a method of operating a dispenser for sheet products.

BACKGROUND OF THE INVENTION

Various types of dispensers for sheet products are known. In any of these dispensers, a stack of sheet products is accommodated within a housing of the dispenser, and the sheet products are removed from the stack through a dispensing opening in the dispenser housing. Examples of types of sheet products that are known to be used in such dispensers are hand towels, toilet tissue, napkins, serviettes and other wiping products in sheet form.

Some of the known dispensers make it possible for the user to take an arbitrary number of sheet products at a time, which often results in the user taking more than is required, causing waste. Other types of dispensers dispense only one sheet product at a time, which in turn can be cumbersome in situations in which there is an urgent need for having a larger number of sheet products at hand.

In order to remedy this dilemma, dispensers are available which dispense a predetermined number of sheet products at a time. Such a sheet product dispenser is, for example, known from Applicant's WO-A1-2014/154282, WO-A1-2014/154284 and WO-A1-2014/154285.

Another automatic dispenser for dispensing discrete paper products is known from WO-A1-2015/050863.

It is desirable to provide a dispenser for sheet products which quickly and accurately dispenses a preselected number of sheet products.

The present disclosure addresses this and other needs and provides advantages and improvements that will become clear from the following general and specific description of embodiments of the invention.

SUMMARY OF THE INVENTION

In a first aspect, a dispenser for sheet products is provided which includes a housing having a space inside for accommodating a stack of sheet products. The housing includes a dispensing opening for dispensing a sheet product from the front of the stack. The dispenser includes an electronic controller. The controller is configured to receive a pull-out signal indicating the removal of a product from the front of the stack through the dispensing opening and, upon receiving said pull-out signal, to send out a drive signal to transfer a number of sheet products from the front of the stack into a presentation position. The controller is further configured to receive a low-level signal indicating that the amount of sheet products left within the housing has been reduced to below a predetermined level and, upon receiving said low-level signal, to enter into a low-level mode in which the sending of the drive signal to the actuator in response to the pull-out signal is disabled.

According to this aspect, it is the removal of a sheet product from the front of the stack through the dispensing opening which triggers the transfer of a number of further sheet products into the presentation position. This obviates the need for the user to act upon an actuation button or other actuation element in order to have a number of sheet products dispensed. Removing a product from the front of the stack, i.e. pulling out a product from the dispenser initiates the dispensing of additional products, unless the amount of sheet products left within the housing has been reduced to below a predetermined level.

Disabling the dispensing of additional sheet products in this low-level mode has two advantageous effects: first of all, the fact that the pulling out of sheet products does not result in the automatic dispensing of more products provides an additional indication for the user that the dispenser needs to be refilled. Secondly, the additional products in the presentation position would make it cumbersome for the user to refill the dispenser with a new stack of sheet products, because the half dispensed sheet products would be in the user's way and would have to be removed before beginning the refilling operation.

The controller could use the low-level mode in order to transmit further signals or disable further functions depending on its programming.

Within the dispenser housing, the products are stacked in a direction from a front towards a back of the stack, with the dispensing opening exposing a part of the front-most product in the stack.

In an embodiment, the dispenser includes a low-level detector for providing the low-level signal to the controller.

In an embodiment, the dispenser further includes a backing element biasing the stack of sheet products towards the dispensing opening, the backing element moving towards the dispensing opening upon depletion of the sheet products from the stack. The detector is configured to detect displacement of the backing element into a predetermined position which is associated with the predetermined level of remaining sheet products.

In an embodiment, the controller is further configured to activate an alarm signal, in particular a visual and/or audible alarm signal, when entering the low-level mode.

In an embodiment, the dispenser further includes a first user interface which is connected to the controller for pre-selecting the number of sheet products to be transferred into the presentation position in response to said pull-out signal.

In an embodiment, the dispenser further includes a user operable command element configured to send a product request signal to the controller upon operation by the user, the controller being configured to send out, upon receiving said product request signal, a drive signal to transfer a second number of sheet products from the front of the stack into the presentation position.

In an embodiment, the dispenser further includes a second user interface which is connected to the controller for pre-selecting the second number of sheet products to be transferred into the presentation position. The second user interface may be integrated with the first user interface. The second number of sheet products may be selectable independent from the first mentioned number of sheet products.

In an embodiment, the controller is configured to send out a drive signal to the actuator in response to a product request signal irrespective of whether the controller is in the low-level mode. In other words, the dispensing of additional products initiated via the user operable command element remains unaffected by the low-level mode.

In an embodiment, the dispenser further includes a transfer device for transferring one or more products from the front of the stack into the presentation position by advancing at least a first portion of the respective product through the dispensing opening. The dispenser can then further include an actuator for activating the transfer device, and the electronic controller can be configured to send out, upon receiving said pull-out signal, a drive signal to the actuator so as to activate the transfer device to transfer a number of sheet products from the front of the stack into the presentation position.

In a second aspect, the present disclosure provides a method of operating a dispenser for sheet products. The dispenser includes a housing having a space inside for accommodating a stack of sheet products, wherein the products are stacked in a direction from a front towards a back of the stack, and wherein the housing includes a dispensing opening for dispensing a sheet product from the front of the stack; and an electronic controller. If a product is removed from the front of the stack through the dispensing opening, the controller is made to receive a pull-out signal indicating the removal of the product. Upon receiving said pull-out signal, the controller sends out a drive signal to transfer a number of sheet products from the front of the stack into a presentation position. If the controller receives a low-level signal indicating that the amount of sheet products left within the housing has been reduced to below a predetermined level, the controller enters into a low-level mode in which the sending of the drive signal in response to the pull-out signal is disabled.

In the low-level mode, the controller may further activate an alarm signal, in particular a visual and/or audible alarm signal.

In an embodiment, the method further includes the step of pre-selecting the number of sheet products to be transferred into the presentation position via a user interface which is connected to the controller.

In an embodiment, the method includes the following additional steps: upon detection of the operation of a user operable command element, the controller is made to receive a product request signal, and upon receiving said product request signal, the controller sends out a drive signal to transfer a second number of sheet products from the front of the stack into the presentation position.

In an embodiment, the method further includes the step of pre-selecting the second number of sheet products to be transferred into the presentation position via a user interface which is connected to the controller. The second number of sheet products may then be selected independent from the first mentioned number of sheet products.

In an embodiment of the method, the controller sends out a drive signal to the actuator in response to a product request signal irrespective of whether the controller is in the low-level mode.

DETAILED DESCRIPTION OF THE INVENTION

The aspects and embodiments which are described above and which will be explained in further detail below are broadly applicable to different types of dispensers such as, and without limitation, table-top napkin dispensers, folded bath tissue dispensers, hand towel folded or interfolded dispensers, countertop napkin dispensers, or in-counter napkin dispensers. As stated above, the sheet products are generally used for wiping, and they may be folded and/or interfolded and may be tissue-based sheet products.

Overall Configuration of the Dispenser

Figure 1:
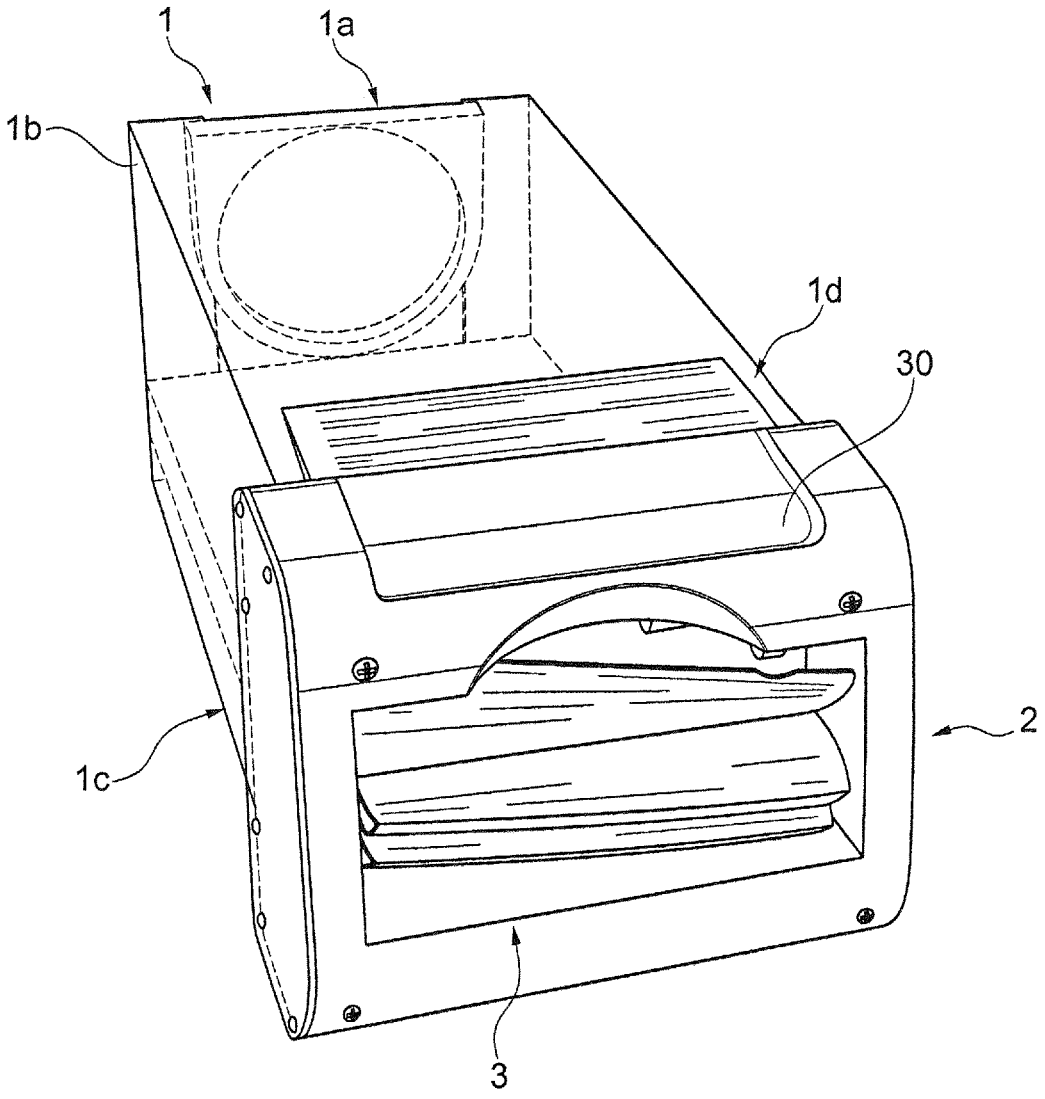
FIG. 1 illustrates a dispenser according to the present disclosure in a perspective front view.

FIG. 1 shows a dispenser according to one embodiment of the present disclosure.

The dispenser includes a housing defining an interior volume for accommodating a stack of sheet products. In the stack of sheet products, the products are stacked in a direction from a front towards a back of the stack, the stacking direction being horizontal in the present embodiment.

In the illustrated embodiment, the housing of the dispenser includes a main or base body 1 including a distal wall 1*a* and four longitudinal sidewalls 1*b*-1*e* for laterally restricting the stack of products. The proximal end of the base body 1 of the dispenser housing is open so as to provide access into the interior of the dispenser housing in order to allow a stack of sheet products to be loaded into the dispenser, and a cover is provided for closing the open proximal end of the base body 1. In this embodiment, the cover has the form of a door 2 that opens by pivoting about hinges. The hinges are arranged vertically in the illustrated embodiment so that the door 2 opens by rotating about a vertical rotation axis, but the hinges could as well be arranged so that their rotational axis is horizontal and the door 2 is pivoted towards the top or the bottom, respectively.

In the housing, a dispensing opening 3 is provided for dispensing a sheet product from the front of the stack. The sheet products would be contained within the housing with their front major surfaces facing the dispensing opening 3. In the present embodiment, the dispenser housing is constituted by the base body 1 and the cover, and the dispensing opening 3 is provided in the cover, i.e. the hinged door 2. In principle it would, however, as well be possible to provide the dispensing opening 3 in a wall of the dispenser housing which does not correspond to a cover. For example, the dispensing opening 3 could be provided in the front wall of the housing while the rear wall of the housing could be removable so as to provide access into the housing.

In the illustrated embodiment, the dispenser housing is elongated horizontally, and the sheet products are dispensed towards the front of the dispenser housing. The dispenser includes a mechanism which biases the stack of sheet products towards the front of the dispenser housing in a manner which will be described in more detail further below. It would, however, as well be possible to have the dispenser arranged vertically so that the sheet products are dispensed towards the top or even towards the downward direction. In the alternative embodiment in which the dispensing opening 3 faced towards the bottom, the dispenser could operate by gravity feed.

Transfer Device

Figure 2:
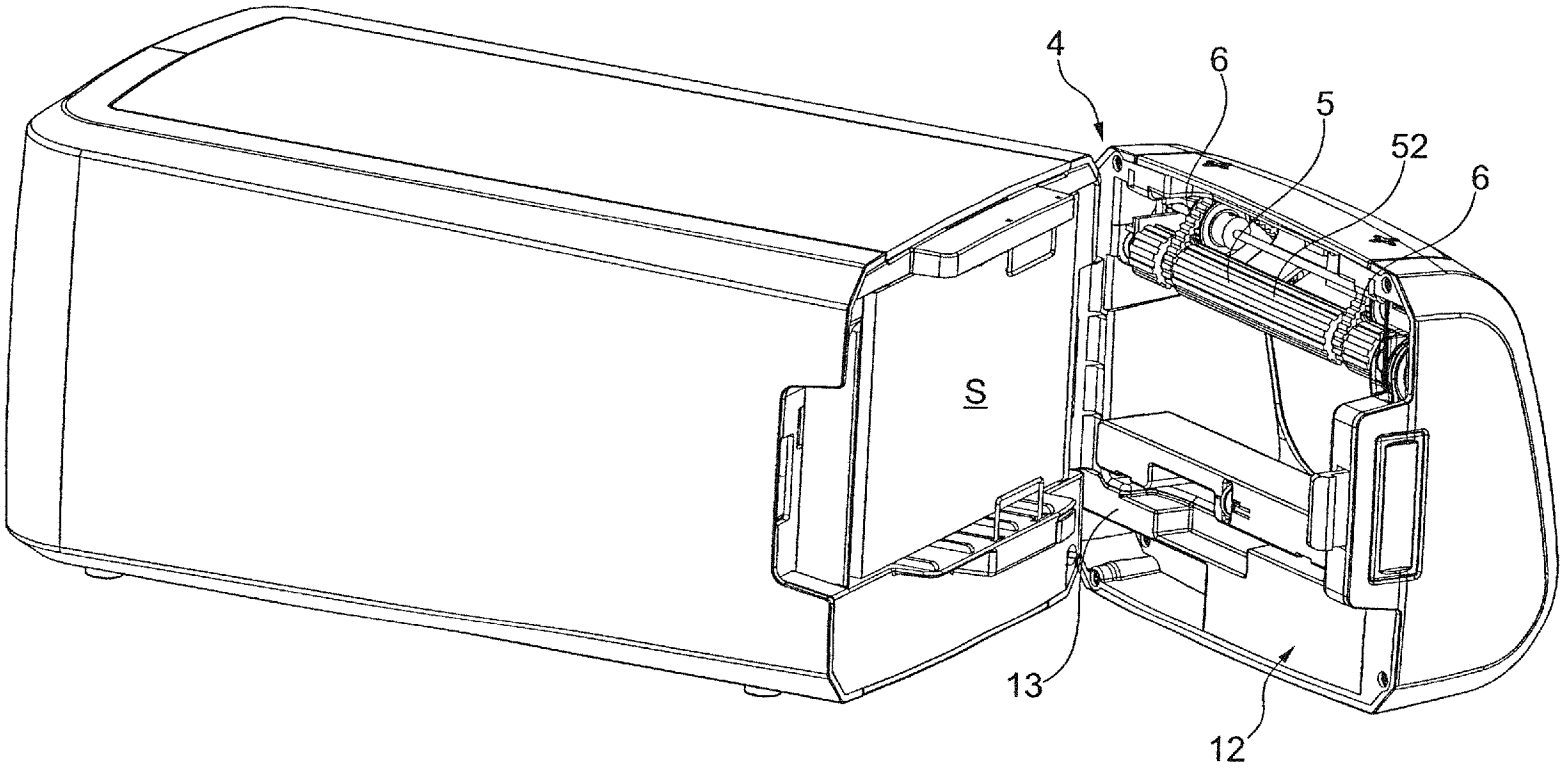
FIG. 2 is an illustration of the dispenser of FIG. 1 with a door at the front of the dispenser housing being opened in order to illustrate the mechanisms provided in the inside of the dispenser.

FIG. 2 illustrates the dispenser in a state in which the door 2 has been partially opened in order to provide access to the interior of the dispenser. The drawing shows a stack S of sheet products contained within the housing with their front major surfaces facing the dispensing opening 3 from the inside. From this illustration, it is apparent that a device for transferring products from the stack S of sheet products through the dispensing opening 3 is integrated within the dispenser housing and in the present embodiment specifically within the hinged door 2 of the dispenser housing.

Figure 3:
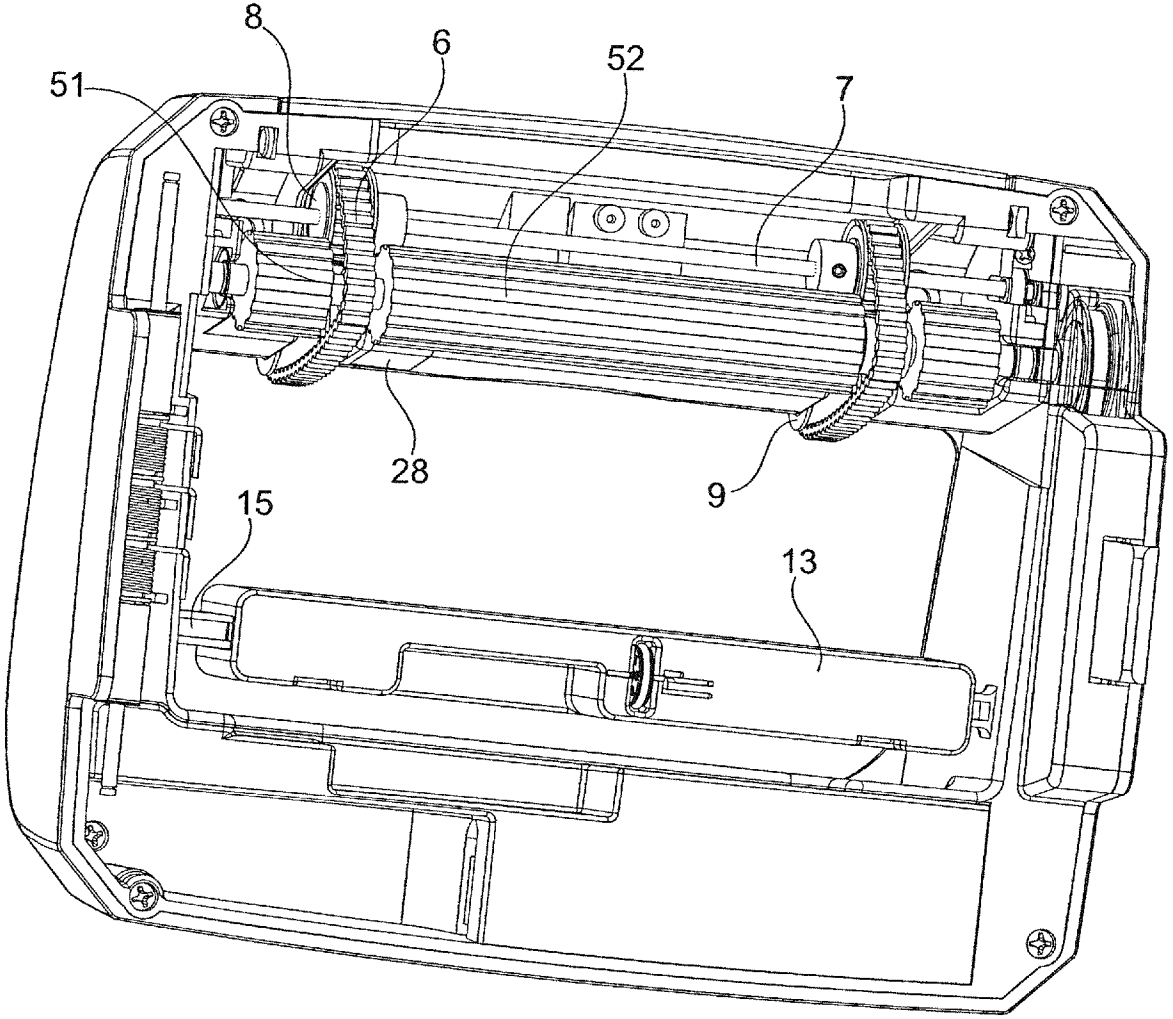
FIG. 3 illustrates the door of the dispenser from the inside.

More particularly, and as is also apparent from FIG. 3 which illustrates the hinged door 2 from the inside, an elongated roller 5 (FIG. 2) which forms part of a transfer device 4 (FIG. 2) is rotatably mounted to the door 2 in a position above the dispensing opening 3. The roller 5 is made up of a central drive shaft 51 made of a relatively rigid material and an outer cladding portion 52 that may be injection-molded or extruded and that may have greater gripping characteristics relative to the material of the sheet products, at least on the outer surface of the cladding portion 52, than does the central drive shaft 51.

In the present embodiment, the cross-section of the roller 5 is generally circular. In alternative embodiments, the profile of the roller includes fins, paddles or lobes. Between the fins, paddles or lobes are relatively recessed parts of the profile that will slip, e.g., slide or not contact, with respect to the front face of the stack. The slip parts of the alternative roller designs allow a front-most sheet to be dispensed without disturbing a succeeding sheet, whereby the slip part of the roller is positioned in registration with the succeeding sheet. It is only when the roller is further rotated such that the next fin, paddle or lobe engages and grips the succeeding sheet, that a succeeding sheet begins to be dispensed.

An actuator is provided in order to operate, i.e. rotate, the roller 5 of the transfer device 4. The actuator in the illustrated embodiment is constituted by an electric motor 12 (FIG. 2), which in this embodiment is accommodated within the hinged door 2 of the dispenser. The motor 12 applies a rotational motion onto the central drive shaft 51 of the roller 5 of the transfer device 4 via a first drive belt. Instead of a belt drive, any alternative transmission could be used to transmit power from the output shaft of the motor 12 to the central drive shaft 51 of the roller 5, for example a chain drive, a gear drive or gear train, friction discs, cams and followers, couplings, and the like.

In an alternative embodiment, the motor could be disposed in the main body of the dispenser housing rather than in the hinged door 2. Arranging the motor close to the transfer device 4 can avoid the necessity of overly complicated transmission elements between the motor and the transfer device.

Via a second drive belt, the motor 12 applies a rotational motion also to an auxiliary drive shaft 7 which is rotationally supported in parallel to the roller 5. Also, instead of the second drive belt, any alternative transmission could be used.

Toothed belts 6 are provided, two in this embodiment, which will be referred to as presentation belts 6 in the following and each of which is driven via a pulley 8 positioned on the auxiliary drive shaft 7 and additionally guided by an additional pulley 9 which is rotationally supported in the region of the upper edge of the dispensing opening 3 further towards an outside of the hinged door 2. The presentation belts 6 are also looped around the roller 5 in corresponding cut-outs 53 provided in the cladding portion 52 of the roller 5.

Gears are provided in connection with the drive belts so as to impart a rotational motion onto the auxiliary drive shaft 7 which is faster than the rotational motion imparted onto the central drive shaft 51 of the roller 5, which results in the surface speed of the presentation belts 6 being larger than the surface speed of the roller 5. The gears and drive belts together form a transmission, and other forms of transmission devices could be provided in order to provide a driving force to the roller 5.

During normal operation of the dispenser, the hinged door 2 is closed, and the outer surface of the roller 5 is positioned in contact with the front face of the stack S of sheet products. The roller 5 is in contact with an upper portion of the first product in the stack S. The roller 5 functions to grip a major surface of a part of the sheet product at the front of the stack S and to slide the same relative to an underlying sheet in the stack S. The roller 5 then passes the sheet product into the dispensing opening 3 once the fold or edge of the gripped sheet product is moved beyond the roller 5. The presentation belts 6 help guiding the upper parts of the sheet products through the dispensing opening 3. Once a particular sheet product has been moved into and through the dispensing opening 3, the succeeding sheet in the stack S will rest against the roller 5.

The roller 5 in this embodiment has a circular cross-section. The outer surface of the roller 5 is required to grip the material of the sheet product, and accordingly, the outer surface of the roller 5 may include sand paper, may be textured or may include dimples or ribs, or may be made of a material that has a high frictional relationship with the material defining the sheet product, such as an elastomeric material. The outer surface may additionally or alternatively include a grooved or raised pattern such as a hedging pattern to increase grip. In other grip enhancing alternatives the outer surface of the roller 5 may be provided by axially or radially extending teeth with the teeth being angled towards or against the direction of rotation when dispensing a sheet product, or they may have a rectangular or sharp profile.

As regards the configuration of the transfer device, other solutions are conceivable as alternatives to the roller 5 and presentation belts 6 described above. For example, the substantially continuous roller 5 could be replaced by a series of individual roller elements arranged spaced apart from each other on the central shaft 51. In a specific embodiment, a pair of pedal wheels could be used.

Stack Retainer

In a state in which the hinged door 2 is closed, lower portions of the products in the stack S, i.e. portions which are located beneath the dispensing opening 3, are engaged by a stack retainer which is also arranged in the hinged door 2. In the illustrated embodiment, the stack retainer includes a retaining bar 13. The retaining bar 13 is provided for retaining the lower portions of the sheet products while the upper portions of the sheet products are passed into and through the dispensing opening 3 by means of the transfer device 4, i.e. the roller 5 and presentation belts 6 in this embodiment, so as to bring the sheet products into the presentation position. The retaining bar 13 further keeps the sheet products in this presentation position by retaining the lower portions of the products until the products are manually retrieved.

In principle, the stack retainer can be fixedly connected to or within the housing of the dispenser, or it can be movably supported thereto or therein. In the present embodiment, the retaining bar 13 is floatingly supported in the hinged door 2: by means of coupling elements 15 at either side, the retaining bar 13 is coupled to the hinged door 2 in a manner so as to have a certain degree of movement in a horizontal plane while being restricted against vertical movement. Because the retaining bar 13 is movable in the horizontal plane, the retaining bar will be displaced horizontally to a certain extent in reaction to a number of sheet products being brought into the presentation position, thereby reducing the force which is applied by the retaining bar 13 onto the lower portion of the stack S of sheet products. Due to the fact that the stack S is supported inside the dispenser so that the upper portions of the sheet products are biased into contact with the transfer device 4, specifically the roller 5, in a manner which will be explained further below, this horizontal yielding of the retaining bar 13 in turn allows for the front of the stack to stay in reliable contact with the roller 5 of the transfer device 4.

The moveable nature of the retaining bar 13 or other stack retainer also accommodates a possible difference in forward displacement between the upper and lower portions of the stack S, so that the transfer device also makes more reliable contact with the sheet products. A difference in forward displacement between upper and lower portions of the products could, e.g., result from geometric tolerances on any stack S of sheet products, or from a situation in which the upper portions of some products have been transferred through the dispensing opening while the lower portions are still retained.

The coupling elements 15 also allow for a certain angular movement of the retaining bar 13, meaning that one longitudinal end of the retaining bar 13 can move further towards the stack S of sheet products than the other longitudinal end, the movement always being restricted to the horizontal plane, though.

The coupling elements 15 further include spring elements for biasing the respective ends of the retaining bar 13 in the horizontal plane towards the stack S of sheet products, thereby promoting a reliable contact between the retaining bar 13 and the stack S, which is favorable, e.g., in view of the dispenser's pull-out detecting function described further below.

The transfer device 4, including the roller 5 and presentation belts 6, and the retaining bar 13 cooperate as follows in order to dispense sheet products: At the location of engagement with the upper portion of the front-most product in the stack S, the roller 5 of the transfer device 4 rotates so that the outer surface thereof moves in the direction towards the retaining bar 13, i.e. in the downward direction in the illustrated embodiment. This causes the sheet product or the upper portion thereof, respectively, to move downwards towards the retaining bar 13. At the same time, the lower portion of the front-most sheet product remains retained within the dispenser housing due to the engagement by the retaining bar 13. The actuation imparted by the roller 5 thus results in the upper part of the sheet product moving into and through the dispensing opening 3, while the lower part of the sheet product still remains pinched between the remainder of the stack S and the retaining bar 13. As such, the sheet product gripped by the roller 5 will be released into and through the dispensing opening 3 to remain suspended at its lower margin at the retaining bar 13. The resulting position of the sheet product, in which its upper part has been transported into and through the dispensing opening 3 while its lower part is still retained by the retaining bar 13, will be referred to as a "presentation position" in the following, considering that the product is now presented to the user and the user can grasp the product at its upper margin and pull it completely out of the dispensing opening 3, thereby releasing the engagement between the lower margin of the product and the retaining bar 13.

Backing Platen

It has been explained above that in a closed state of the hinged door 2, the upper part of the front-most product in the stack S is in contact with the outer surface of the roller 5 of the transfer device 4 while the lower part of the product is retained by the retaining bar 13. In order to provide for a reliable contact between the roller 5 and the retaining bar 13 with the front-most product in the stack S, the retaining bar 13 is biased towards the stack S of sheet products. At the same time, the stack S of products is supported inside the dispenser so as to be biased towards the inside of the hinged door 2, i.e. towards the transfer device 4 and the retaining bar 13, so as to further enhance a reliable engagement between these elements and the front of the stack S.

This will now be described with reference to FIG. 4, which shows the dispenser with one side panel of the housing removed so as to illustrate the interior of the dispenser housing. In the inside of the dispenser housing, a backing platen 16 is provided for engaging the rearmost product in the stack S. By means of a biasing mechanism, which in the illustrated embodiment is constituted by two constant force pull springs (coil springs) 18, the backing platen 16 is pulled in the direction of the dispensing opening 3 with a constant pulling force.

Figure 4:
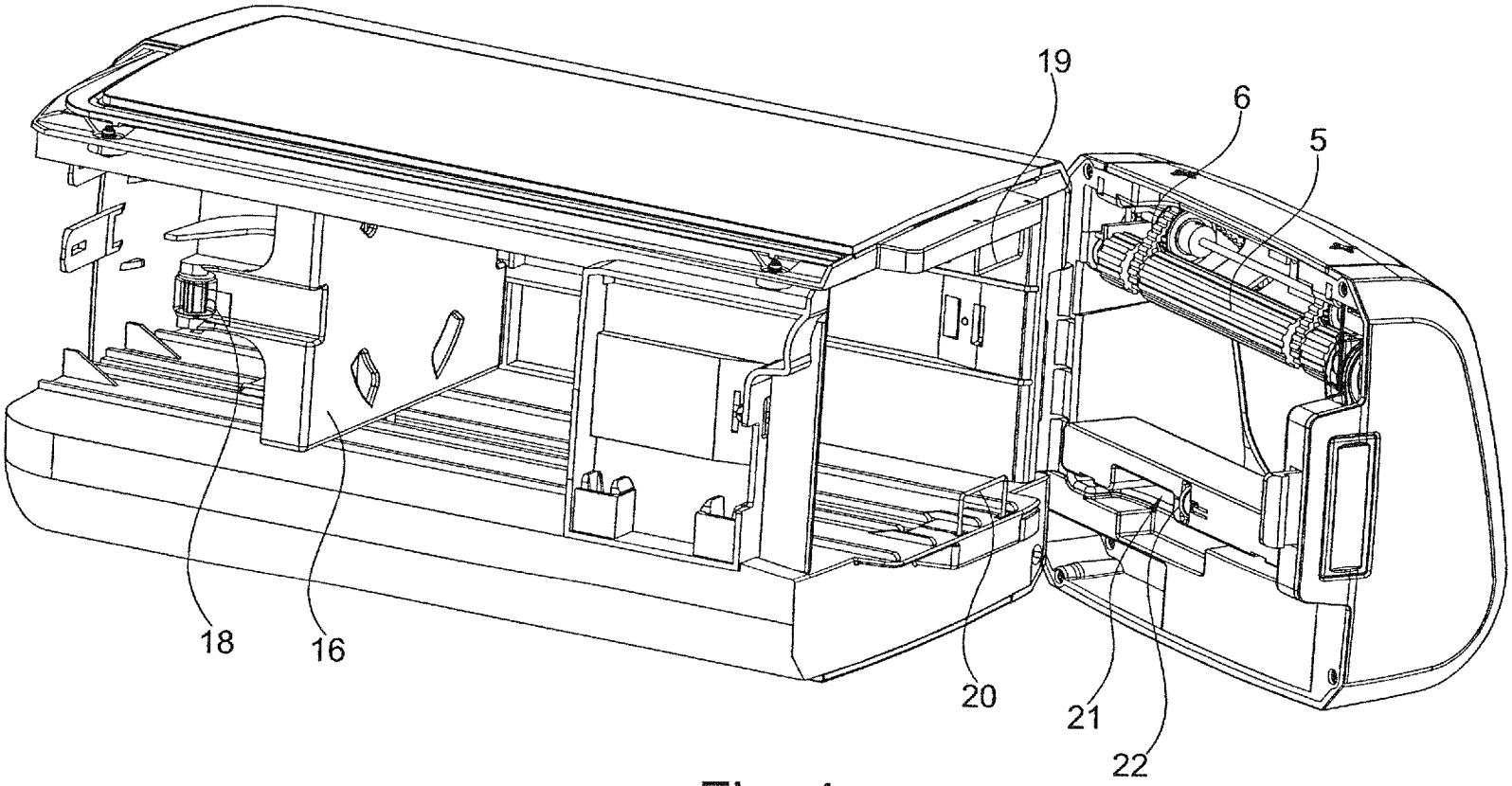
FIG. 4 is an exploded view of the dispenser.

FIG. 4 also shows that measures are taken to retain the sheet products in the state in which the door 2 is opened, and the engagement between the roller 5 and the retaining bar 13 is released. Due to the biasing of the backing plate towards the inside of the hinged door 2, opening of the door 2 would result in the products spilling out of the dispenser housing. In order to prevent this from happening, a holdback structure, constituted by two wire forms 19, 20 in the illustrated embodiment, is provided in the area of the open proximal end of the base body of the dispenser housing.

In the present embodiment, the wire forms 19, 20 are pivotable towards the interior of the dispenser housing, so that they give way when the user refills the dispenser by pushing a stack S of sheet products into the housing via the open proximal end. In other embodiments, the wire forms or other holdback structure can be rigidly connected with the housing, in which case the user pushes a stack S of sheet products past the holdback structure and into the housing for refilling the dispenser.

In the illustrated embodiment, the retaining bar 13, which is floatingly supported to the hinged door 2 as described further above, includes a recess 21 which has a shape corresponding to the shape of the lower one 20 of the two wire forms. As soon as the door 2 is closed, the recess 21 in the retaining bar 13 engages with the wire form 20 in the dispenser housing and takes over the function of retaining the lower portions of the sheet products within the dispenser by elastically pressing against the front surface of the first product in the stack S.

Instead of the wire forms 19, 20, the holdback structure could include other types of holdback elements, for example holdback elements made from sheet metal or from plastic. In any case, the holdback elements should be relatively small and light so as to allow for them to be easily pivoted, or otherwise moved, out of interference with a fresh stack of products inserted during refill.

Controller

Now that the structural elements of the dispenser have been described, an explanation will be given of the operation of the dispenser to dispense sheet products from the stack S.

It has been outlined above with reference to FIG. 3 that the transfer device 4 of the dispenser is activated by an electronic actuator which in the present embodiment is constituted by the motor 12 accommodated within the hinged door 2. In order to operate the motor 12 and thereby activate the transfer device 4, the dispenser includes a controller operably connected to the motor 12. The controller is situated on a main printed circuit board of the dispenser.

In general terms, the controller provides logic and control functionality for operation of the dispenser and is configured to receive and transmit a variety of signals. More specifically, the controller activates the transfer device 4 in order to dispense sheet products from the front of the stack S in response to product request signals received by the controller. Product request signals may be generated in various ways which will now be described in detail.

Pull-Out Detector

First of all, one event which results in a product request signal to be received by the controller is the pulling out of a sheet product from the front of the stack S through the dispensing opening 3. The dispenser has the ability to detect that the user pulls out a sheet product through the dispensing opening 3, and this pulling out produces a product request signal for the controller which in turn initiates the dispensing of further sheet products from the front of the stack S.

In the present embodiment, a pull-out detector is provided which detects the removal of a product from the front of the stack S through the dispensing opening 3 and provides a corresponding pull-out signal to the controller. The pull-out detector includes a detection element which is supported in the dispenser housing so as to be movable and in contact with the front-most product in the stack S, so as to be set in motion upon the removal of a product from the front of the stack S through the dispensing opening 3.

In the illustrated embodiment, the detection element includes a wheel 22 which is rotatably supported within the retaining bar 13 so as to extend partially out of the surface of the retaining bar 13 and contact the front of the stack S of sheet products in the lower part of the stack S. The rotary wheel 22 is supported by the retaining bar 13 so as to be rotatable about an axis which is parallel to the longitudinal extension of the retaining bar 13 and perpendicular to the stacking direction of the products in the stack S. As a consequence, the rotational axis of the rotary wheel 22 is parallel to the rotational axis of the roller 5 of the transfer device 4.

Since the rotary wheel 22 protrudes from the retaining bar 13 towards the stack S of sheet products, and the retaining bar 13 is biased towards the stack S of sheet products and the stack S of sheet products is biased towards the retaining bar 13 in the manner described further above, the rotary wheel 22 is always in secure contact with the front-most sheet in the stack S as soon as the door 2 of the dispenser is properly closed.

In order to further enhance the frictional contact between the rotary wheel 22 and the product at the front of the stack S, the contact surface of the rotary wheel 22 is provided with a friction enhancing O-ring about its outer circumference.

In view of the fact that the rotary wheel 22 is in contact with the front-most product in the stack S of products within the dispenser, the pulling out of this front-most product through the dispensing opening 3 initiates a rotation of the rotary wheel 22. This motion of the rotary wheel 22 is made use of in order to provide a corresponding pull-out signal to the controller, i.e. make the controller aware of the fact that a product has been pulled out: the pull-out detector further includes a sensor for translating the motion of the detection element, i.e. rotary wheel 22 in this embodiment, into electrical signals which are transmitted to the controller.

Various possibilities are conceivable for translating the rotation of the rotary wheel 22 into an electric signal. In the illustrated embodiment, the rotary wheel 22 is supported to the retaining bar 13 so as to be freely spinning relative to the retaining bar 13, and magnets are incorporated into the rotary wheel 22 which cooperate with magnetic sensors, specifically Hall effect sensors, which are arranged within the retaining bar 13 adjacent the rotary wheel 22. In an example, six magnets are provided about the circumference of the rotary wheel 22 with alternating north and south poles, and two Hall effect sensors are provided in the retaining bar 13 facing the arrangement of magnets in the rotary wheel 22 so as to detect any rotation of the rotary wheel 22.

The rotary wheel 22 is freely spinning and cooperates with a circuit board with two Hall effect sensors. The Hall effect sensors measure the position of the magnet. Software thresholds are adjustable as to how many magnet poles have to go by the Hall effect sensors in order to trigger the product request signal. The magnets have to pass within a certain time limit, for example 100 msec.

The controller receives the electrical signal from the Hall effect sensors and processes the signals in order to determine whether or not a product has indeed been removed from the stack S. In fact, a slight rotation of the rotary wheel 22 could as well result from vibrations or the like, and in order to exclude that such slight rotations of the rotary wheel 22 are mistaken as signifying the removal of a product, the controller is suitably programmed so as to recognize a product removal only if a certain minimum amount of rotation has been exceeded. For example, the controller can be programmed so as to recognize a removal only if the electrical signals signify that two of the six magnets on the rotary wheel 22 must have passed one of the Hall effect sensors.

Once the controller has determined from the electrical signals provided by the pull-out detector that a product has been pulled out, the controller provides a command signal to the motor 12, which in turn rotates the roller 5 and presentation belts 6 of the transfer device 4 in order to bring additional sheet products into the presentation position. In this manner, the pulling out of a product from the dispensing opening 3 results in the controller receiving a product request signal and automatically initiating the transfer of further products into the presentation position.

For detecting the rotation of the rotary wheel 22, other solutions are conceivable, including infrared transmitters and receivers or even rotary mechanical switches. In more general terms mechanical, optical and magnetic sensors constitute possible solutions. The aforementioned magnetic sensor is sufficiently robust and reliable to securely detect the pulling out of the front-most sheet product from the stack S.

The rotary wheel 22 provides a reliable way of detecting the movement of the sheet products by physical contact between the wheel and the sheet product. However, instead of a rotary wheel 22, any alternative detection element can be employed as long as the detection element is arranged and configured so as to be displaced by frictional contact with the sheet product which is being pulled out, and so long as the displacement of the detection element can be detected by a sensor.

User Interface

The present dispenser provides the possibility for the user to preselect the number of sheet products which are brought into the presentation position in case a sheet product is pulled out from the dispensing opening 3 and the product request signal is created in the manner described. In order for the user to preselect the number of products to be dispensed upon removal of a product, a user interface 25 is provided which will now be described in more detail with reference to FIG. 5.

Figure 5:
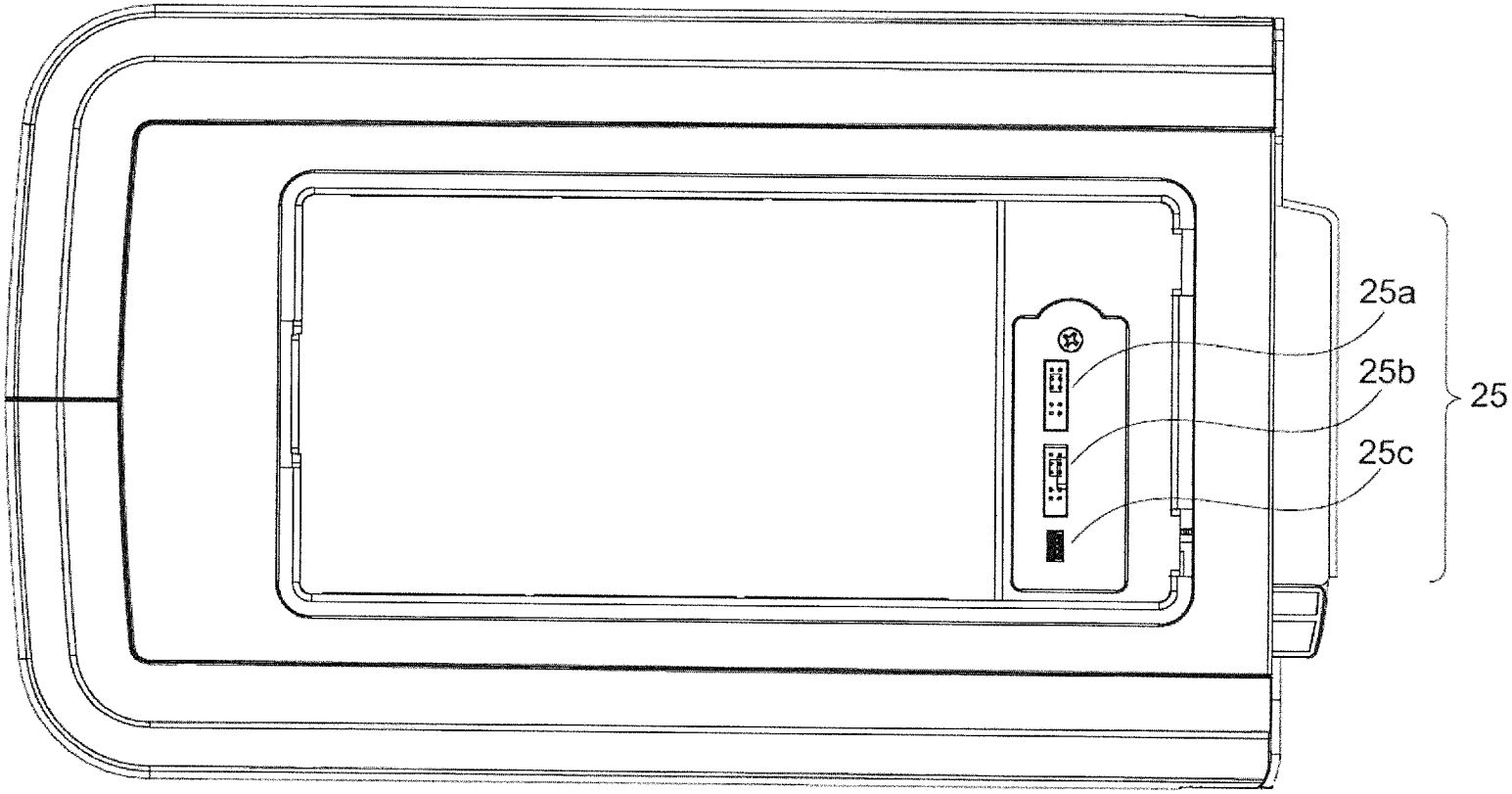
FIG. 5 shows a user interface of the dispenser.

FIG. 5 shows the dispenser from the bottom with a bottom cover plate being removed. The user interface 25 in the present embodiment is constituted by two mechanical switches 25*a*, 25*b*, e.g. slide switches, which allow for the setting of two different numbers of paper products to be dispensed. One of the mechanical switches is for preselecting the number of sheet products which are dispensed upon removal of a product through the dispensing opening 3, as described above. In the present embodiment, the user interface 25 also includes a USB port 25*c* for data acquisition. The aforementioned controller would suitably be located adjacent to this user interface 25.

The reason why the user interface 25 in the present embodiments includes two different input switches 25*a*, 25*b* for selecting two different number of paper sheet products is that the dispenser provides for a second alternative user operation which also results in the controller receiving a product request signal. In fact, as illustrated throughout the drawings, the dispenser includes an additional operating element, in the present embodiment in the form of a push button 30 situated on an upper surface of the hinged door 2, which can be acted upon by the user in order to request the transfer of a second predetermined number of sheet products into the presentation position. It is this second predetermined number of sheet products which can be preselected via the second switch 25*b* on the user interface 25, in addition to the predetermined number of sheet products which is brought into the presentation position once the user pulls a sheet product out of the dispensing opening 3 in the manner previously described.

While the user interface 25 in the present embodiment is constituted by the two mechanical switches 25*a*, 25*b*, e.g. slide switches, alternative solutions are conceivable for the user interface. For example, arrow keys and an associated display could be provided. Using one or more rotary knobs or push buttons would be possible as well.

In normal operation, the user interface 25 would be covered by a lid to avoid unauthorized operation of the user interface 25. In other embodiments, the user interface can, however, as well be uncovered and readily accessible for anyone. The user interface could then be positioned, e.g., on a sidewall of the dispenser housing so as to further facilitate access thereto.

Alternatively or in addition, the user interface can be configured so as to receive signals via a remote control connection, so that it is possible for the user to change the setting of the predetermined number or numbers of sheet products from a remote location such as a cash register. The remote control connection can be a wired connection or a wireless connection such as a WiFi or Bluetooth connection. If the remote control is provided in addition to mechanical switches, the controller can be programmed so as to give preference to the remote control signals over the mechanical settings.

Counting Dispensed Products

From the above explanations, it has become clear that the present dispenser allows the user to pre-select at least one predetermined number of sheet products which are brought into the presentation position in reaction to a product request signal, which can, e.g., be a pull-out signal signifying the removal of a product through the dispensing opening 3 or a signal associated with an operating element such as the aforementioned push button 30 on the top of the hinged door 2.

The data indicating the number of sheet products transferred into the presentation position could, for example, be obtained by way of calculation. A certain amount of rotation of the roller 5 and presentation belts 6 of the transfer device 4 could be associated with the transfer of one product into the dispensing position.

However, in order to provide for a more accurate dispensing of the respective preselected number of sheet products, the dispenser of the present embodiment further includes a sensor 28 (cf. FIG. 3) which cooperates with the controller in order to keep track of the number of sheet products which is brought into the presentation position by means of the transfer device 4.

In the illustrated embodiment, this sensor 28 is located in the area of the roller 5 of the transfer device 4, and it is provided in the form of a contact-less motion sensor, e.g. an infrared (IR) sensor. Other possible solutions involve different contact-less motion sensors, e.g., an ultrasonic time-of-flight sensor, a microwave sensor or even a video camera or a combination of two of these technologies. The sensor 28 is covered by a glass plate which only transmits infrared light towards the sensor 28 while filtering out other wavelengths. The IR sensor 28 measures the amount of reflected infrared energy, and it measures more energy if an object is closer and less energy if an object is further away from the sensor 28. A flexion point in the amount of energy received by the IR sensor 28 therefore indicates that a sheet product has passed the area of the sensor 28. The IR sensor 28 translates the received amounts of infrared energy into electrical signals which are transmitted to the controller.

Using a contact-less sensor 28 avoids any interferences between the sensor 28 and the upper margins of the products which are transferred through the dispensing opening 3. The sensor 28 is suitably located opposite the area where the upper margins of the products pass through the dispensing opening 3.

The controller includes a memory for receiving and storing data, including the number or numbers of sheet products to be dispensed upon reception of a pull-out signal or other product request signal, the number(s) being preselected via the user interface 25, and the number of momentarily dispensed sheet products. The controller actuates the motor 12 to rotate the transfer roller 5 to dispense sheet products or bring them into the presentation position, respectively, until the number of sheet products requested has passed the IR sensor 28, and then the controller immediately stops spinning the roller 5 to stop the dispensing process. Advantageously, the controller is thereby put in a position to self-verify that the number of sheet products dispensed meets the requested number of sheet products associated with the product request signal.

Low-Level Mode

An additional function provided by the controller of the present dispenser is the ability to detect a state in which the remaining amount of sheet products in the dispenser falls below a predetermined limit, and to take actions in reaction to the detection of this low filling level.

As explained further above, a movable backing platen 16 pushes the stack S of sheet products in the direction of the dispensing opening 3. The platen 16 includes an engagement member 16*a* which is arranged in sliding engagement with a guiding rail 17 formed in dispenser housing. A switch is provided within the dispenser housing within the travel path of the platen so as to interfere with the movement of the platen 16 or its engagement element 16*a*, respectively, at a predetermined position of the platen 16 which corresponds to the reduced amount of sheet products. The switch closes as soon as the platen has approached the dispensing opening 3 to an extent which signifies that the remaining amount of sheet products in the dispenser has been reduced below the minimum limit.

Figure 6:
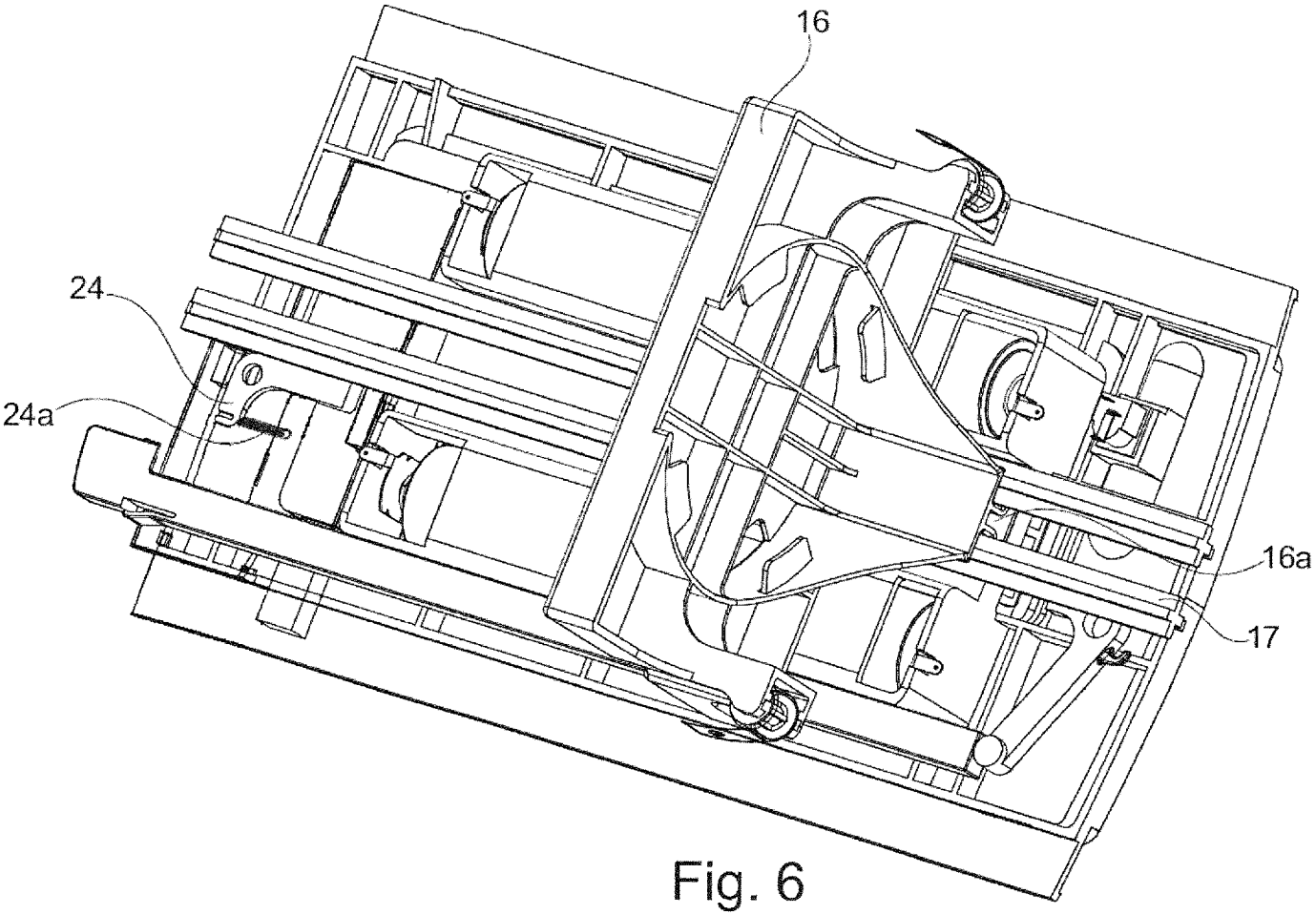
FIG. 6 illustrates a device included in the dispenser for determining that the amount of sheet products within the dispenser has been reduced to below a predetermined limit.

We refer to FIG. 6 for an illustration of the engagement member of the platen 16 which interferes with the switch in order to initiate the low-level mode. The drawing illustrates the platen 16 with its engagement member 16*a* sliding within the guiding rail 17 which in this case is located near the bottom of the dispenser housing. The switch is actuated by an arm 24 in the present embodiment, and the arm 24 is rotatably mounted and biased into the position illustrated in the drawing by means of a spring 24*a*. Since the platen 16 is biased towards the dispensing opening 3, gradually depleting the dispenser of sheet products will move the platen 16 further into the direction of the dispensing opening 3. As soon as the platen 16 has arrived at the location of the arm 24, the engagement member 16*a* of the platen pushes against the arm 24, so as to rotate the arm 24 out of the travel way of the engagement member in the clockwise direction in the drawing against the biasing force of the spring 24*a*, thereby actuating the switch which initiates the controller to enter the low-level mode.

While the switch which initiates the controller to enter the low-level mode is actuated mechanically by the rotary arm 24 in the present embodiment, other solutions for are readily conceivable. For example, a magnet positioned on the backing platen 16 could cooperate with a Hall effect sensor in order to output a signal if the platen has approached the dispensing opening 3 to an extent which signifies that the remaining amount of sheet products in the dispenser has been reduced below the minimum limit. Another possible solution would involve an ultrasonic time-of-flight sensor.

The output of the switch is connected to the main printed circuit board where it is input to the controller on the main circuit board. As soon as the controller detects the low level of remaining products, the controller enters a low-level mode. In the low-level mode, at least one predetermined action is performed by the controller. In the present embodiment, two specific actions are taken: On the one hand, the controller will initiate a signal light to be switched on, which signal light in the present embodiment is located on the hinged door 2 above the dispensing opening 3 at the front of the housing so as to be clearly visible for the operator. The signal light could, for example, be an LED light, and it could also be located on the main body of the housing of the dispenser rather than on the hinged door 2. On the other hand, in the low-level mode, the controller will disable the dispensing of additional sheet products in reaction to the pulling out of one product from the front of the stack S. In other words, while the pull-out detector continues detecting the pulling out of products through the dispensing opening 3 and sending corresponding signals to the controller, the controller does not react to these signals by activating the motor 12 to rotate the roller 5 and presentation belts 6 of the transfer device 4.

Disabling the dispensing of additional sheet products in this low-level mode has two advantageous effects: first of all, the fact that the pulling out of sheet products does not result in the automatic dispensing of more products provides an additional indication for the user that the dispenser needs to be refilled. Secondly, the additional products in the presentation position would make it cumbersome for the user to open the door 2 and to refill the dispenser with a new stack S of sheet products, because the half dispensed sheet products would be in the user's way and would have to be removed before beginning the refilling operation.

The controller could use the low-level mode in order to transmit further signals or disable further functions depending on its programming. For example, the controller could even completely stop the operation of the dispenser, or reduce the number of sheet products dispensed in reaction to a pull-out to one product at a time, irrespective of the predetermined number selected via the user interface 25, in order to make the remaining products in the dispenser last longer and prompt the user to take care of the refilling sooner rather than later.

Operational Sequences

Figure 7:
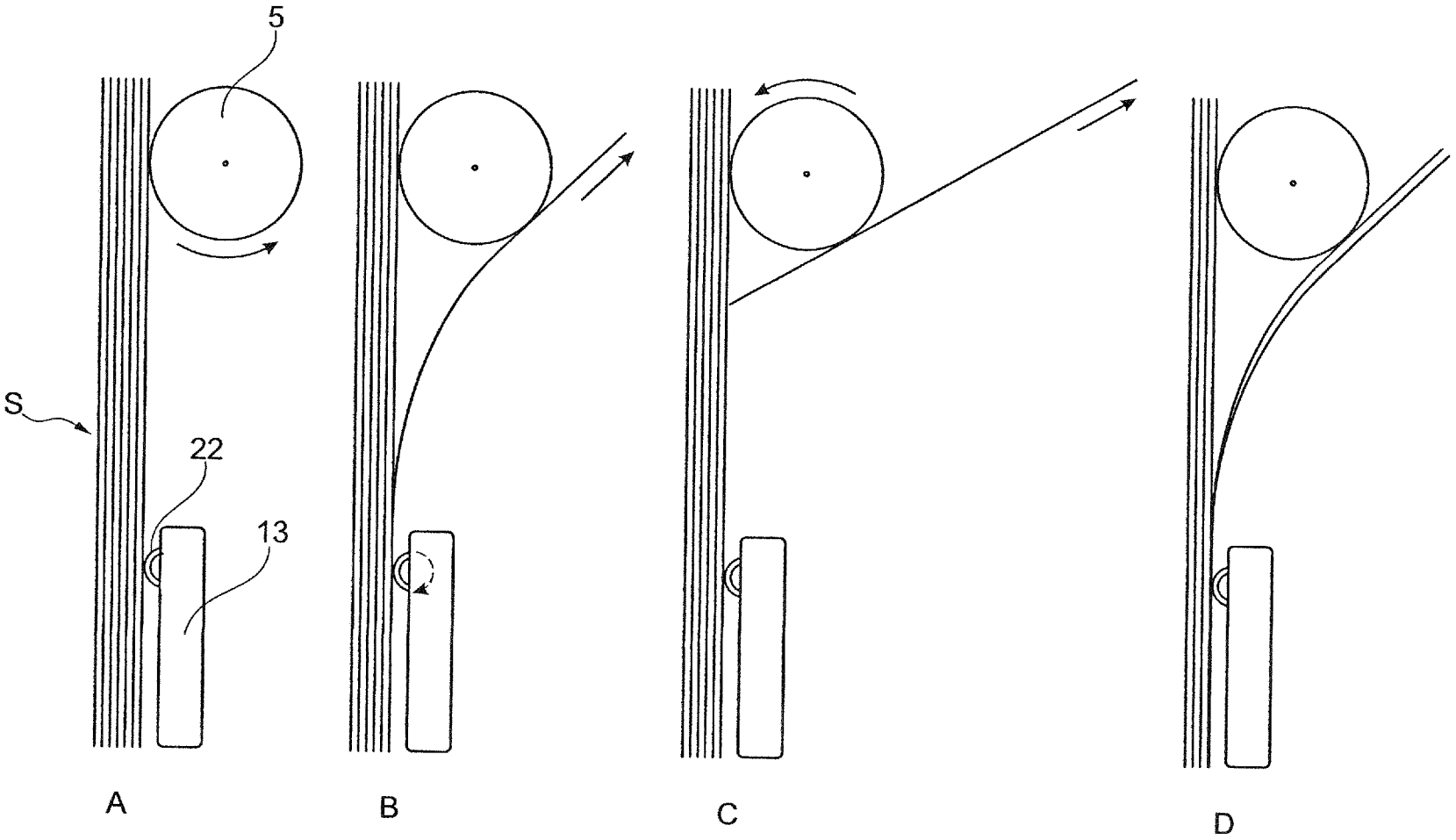
FIGS. 7 and 8 illustrate sequences of sheet products being dispensed from the dispenser, using single sheets (FIG. 7) and interfolded sheets (FIG. 8).
Figure 8:
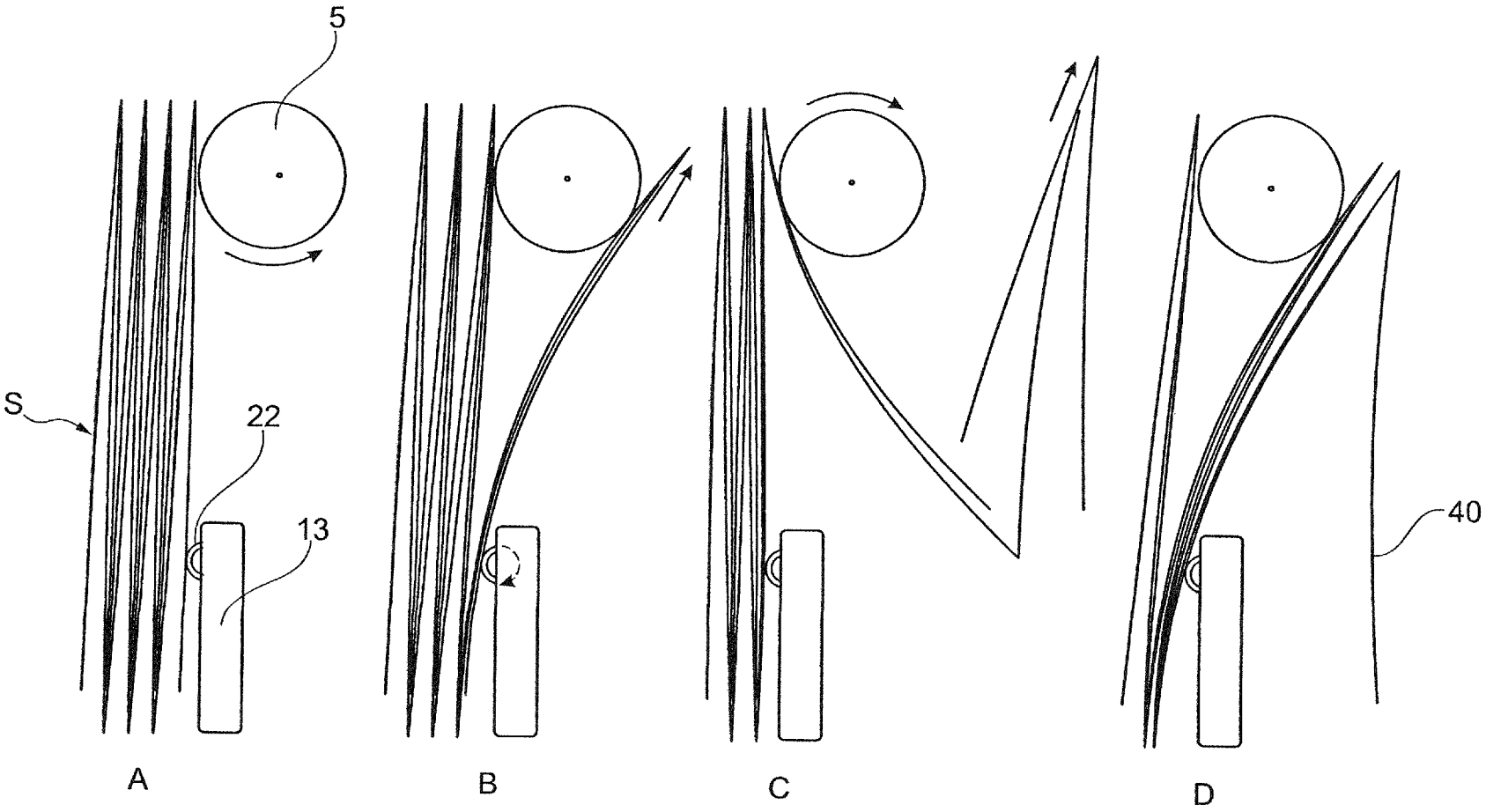

Finally, FIGS. 7 and 8 schematically illustrate possible sequences of operation of the dispenser for the case in which single unfolded napkins are dispensed (FIG. 7) and for the case in which interfolded napkins are dispensed (FIG. 8).

Turning first to FIG. 7, FIG. 7A shows the initial state of the dispenser after refilling it with a fresh stack S of napkins which are single unfolded napkins in this case. By operating the push button 30 at the top of the dispenser housing, a product request signal is sent to the controller, which in turn operates the motor 12 to turn the transfer roller 5 until the preselected number of napkins has been brought into the presentation position, the number of napkins in turn being verified by means of the IR sensor 28. In the example, it is assumed that the predetermined number of napkins to be dispensed when the user operates the push button 30 is one napkin (preselected via the user interface 25). The resulting situation is illustrated in FIG. 7B, i.e. one napkin has been transferred into the presentation position in which its upper margin has passed through the dispensing opening 3 while its lower margin is still retained within the dispenser housing by means of the retaining bar 13.

The user would now grasp the upper part of this napkin and pull it completely out of the dispensing opening 3. The pulling out of the napkin is in turn detected by means of the rotary wheel 22 in the retaining bar 13, which is also illustrated schematically in the drawings. FIG. 7B shows how the rotary wheel 22 is set into rotation due to its frictional contact with the napkin which is being pulled out through the dispensing opening 3.

FIG. 7C shows that the pulling out of the napkin in FIG. 7B, which has been detected by the pull-out detector including the rotary wheel 22, is in turn used by the controller in order to send a command signal to the motor 12 to initiate the dispensing of the predetermined number of additional sheet products by rotating the roller 5 of the transfer device 4. In the present example, the number of napkins to be dispensed in reaction to the pulling out of one napkin is two (preselected via the user interface 25). FIG. 7D shows that as a result, two napkins are provided in the presentation position.

The user could now pull the two napkins out of the dispenser, which in turn would be detected by the pull-out detector and would result in two further napkins being brought into the presentation position, the resulting state of the dispenser being again as shown in FIG. 7D. The user also has the option to actuate the push button 30 before taking out the two napkins. Actuating the push button 30 would bring one additional napkin into the presentation position (the number being preselected via the user interface 25) so that a total of three napkins would be provided in the presentation position for the user to take.

FIG. 8 shows corresponding operational steps for the case in which the dispenser is filled with a stack S of interfolded sheet products. In a manner known per se, each product within the stack S includes two panels which are connected by a fold, and each product in the stack S (with the exception of the first and last products in the stack S) receives between its two panels one panel from each adjacent product in the stack S.

FIG. 8A shows the stack S in the initial state in which it has just been filled into the dispenser. Actuating the push button 30 at the top of the housing provides a product request signal to the controller in order to bring the preselected number of products into the presentation position, which in the present case is one. Note that due to the interfolding of the products, the roller 5 of the transfer device 4 in this case acts upon the folds at the upper margins of the folded products to bring the products into the presentation position. This in turn means that together with the upper part of the first product in the stack S, also the first panel of the second product in the stack S is brought into the presentation position, as illustrated in FIG. 8B, because this first panel of the second product is received between the two panels of the first product. As a consequence, when gripping the first folded product in the presentation position and pulling it out of the dispenser, the user at the same time pulls the first panel of the second folded product through the dispensing opening 3, as illustrated in FIG. 8C.

This in turn results in the lower margin of the first panel of the third product in the stack S being released from the retaining bar 13, thereby forming a tail 40 hanging out of the dispensing opening 3. In other words, the first two products have been removed from the dispenser, and the first panel of the third product in the stack S is now retained by the transfer roller 5 at its upper margin, whereas the lower margin of the third product has been released from the retaining bar 13.

At the same time, the pulling out of the first product from the dispensing opening 3 (FIG. 8B) has been detected by the pull-out detector including the rotary wheel 22 and has triggered the controller to rotate the roller 5 and presentation belts 6 in order to bring the predetermined number of additional sheet products into the presentation position, the additional number being two in the present embodiment. In view of the interfolded configuration of the products in the stack S, this means that two folds forming the upper edges of folded products in the stack S are transferred into the presentation position.

FIG. 8D illustrates the final configuration, in which the preselected number of two folds has been brought into the presentation position so that the products associated with the two folds are now ready to be gripped by the user and to be pulled out. Due to the interfolding, the user will obtain a total of four napkins, i.e. the two napkins forming the two folds plus the two napkins interfolded therewith. The pulling out of the napkins (strictly speaking, as becomes clear from FIG. 8D, the pulling out of the first panel of the second napkin in the stack S) will again be detected by the pull-out detector using the rotary wheel 22, and will trigger the transfer of two further folds of products into the presentation position, the resulting state of the dispenser being again as shown in FIG. 8D.

Similar as in the case of the single sheets, the user also has the option to actuate the push button 30 before taking out the two napkin folds or four napkins, respectively. Actuating the push button 30 would bring one additional napkin fold, i.e. two napkins, into the presentation position (the number being preselected via the user interface 25) so that a total of three napkin folds or six napkins would be provided in the presentation position for the user to take.

Further with respect to FIG. 8D, it is apparent that a further possibility is provided for the user to remove sheet product from the dispenser, also irrespective of the transfer device and also in the case in which the dispenser's electric power supply should fail: it has been explained that as a result of the sheet products being pulled out of the dispenser, the lower margin of the first panel of the sheet product which is now located at the front of the stack forms a tail 40 hanging out of the dispensing opening 3. This results from the use of an interfolded sheet product arrangement. Imagining a user grasping on the hanging tail 40 shown in FIG. 8D, this would pull out a new tail of the front-most sheet product in the stack, thereby making it possible for the user to pull out the sheet products one by one. In order to facilitate this manual pulling-out of individual sheet products, the transfer device 4 of the dispenser can be provided with a one-way bearing for the roller 5 thereof, so as to allow for the roller 5 to spin freely in its dispensing direction of rotation, independent of its drive mechanism. The roller 5 should suitably be blocked against rotation in the opposite rotational direction, though.

In the above examples, the first predetermined number of sheet products, i.e. the number of napkins to be dispensed in reaction to the pulling out of one napkin (preselected via the user interface 25) is two napkins or two napkin folds, respectively. The number of sheet products to be transferred into the presentation position in response to said pull-out signal can, however, be arbitrarily set to values other than two. The number could, e.g., be set to one, three, four, or more, or also to zero so that no sheet products are transferred into the presentation position in response to the pull-out signal.

Similar considerations apply to the second predetermined number of sheet products, i.e. the number of napkins to be dispensed when the user operates the push button 30 (preselected via the user interface 25): in the above examples, the second predetermined number is one napkin or one napkin fold, respectively. The second number of sheet products can, however, be arbitrarily set to values other than one. The number could, e.g., be set to two, three, four, or more, or even to zero so that no sheet products are transferred into the presentation position when the user operates the push button 30.

In a specific example, the first predetermined number of sheet products is four, and the second predetermined number of sheet products is two.

In further specific examples, the first predetermined number of sheet products is zero, and the second predetermined number of sheet products is one, two, three, four, or more.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A dispenser for sheet products, comprising:

a housing having a space inside for accommodating a stack of sheet products, wherein the housing includes a dispensing opening for dispensing a sheet product from a front of the stack; and an electronic controller, the controller being configured to receive a pull-out signal indicating a removal of a product from the front of the stack through the dispensing opening and, upon receiving said pull-out signal, to send out a drive signal to transfer a first number of sheet products from the front of the stack into a presentation position, wherein the controller is further configured to receive a low-level signal indicating that an amount of sheet products remaining within the housing has been reduced to below a predetermined level, wherein one or more sheet products remain within the housing, and, upon receiving said low-level signal, to enter into a low-level mode in which the sending of the drive signal in response to the pull-out signal is disabled.

2. The dispenser of claim 1, wherein the dispenser comprises a low-level detector for providing the low-level signal to the controller.

3. The dispenser of claim 2, further comprising a backing element biasing the stack of sheet products towards the dispensing opening, the backing element moving towards the dispensing opening upon depletion of the sheet products from the stack, wherein the low-level detector is configured to detect displacement of the backing element into a predetermined position which is associated with the predetermined level of remaining sheet products.

4. The dispenser of claim 1, wherein the controller is further configured to activate an alarm signal comprising a visual and/or audible alarm signal when entering the low-level mode.

5. The dispenser of claim 1, wherein the dispenser further comprises a first user interface which is connected to the controller for pre-selecting the first number of sheet products to be transferred into the presentation position in response to said pull-out signal.

6. The dispenser of claim 5, further comprising a user operable command element configured to send a product request signal to the controller upon operation by the user, the controller being configured to send out, upon receiving said product request signal, a drive signal to transfer a second number of sheet products from the front of the stack into the presentation position.

7. The dispenser of claim 6, further comprising a second user interface which is connected to the controller for pre-selecting the second number of sheet products to be transferred into the presentation position.

8. The dispenser of claim 7, wherein the second user interface is integrated with the first user interface.

9. The dispenser of claim 7, wherein the second number of sheet products is selectable independent from the first number of sheet products.

10. The dispenser of claim 6, wherein the controller is configured to send out a drive signal to the actuator in response to a product request signal irrespective of whether the controller is in the low-level mode.

11. The dispenser of claim 1, further comprising a transfer device for transferring one or more products from the front of the stack into the presentation position by advancing at least a first portion of the respective product through the dispensing opening.

12. The dispenser of claim 11, further comprising an actuator for activating the transfer device, wherein the electronic controller is configured to send out, upon receiving said pull-out signal, a drive signal to the actuator so as to activate the transfer device to transfer a number of sheet products from the front of the stack into the presentation position.

13. A method of operating a dispenser for sheet products, the dispenser comprising:

a housing having a space inside for accommodating a stack of sheet products, wherein the products are stacked in a direction from a front towards a back of the stack, and wherein the housing includes a dispensing opening for dispensing a sheet product from the front of the stack; and an electronic controller;

wherein:

if a product is removed from the front of the stack through the dispensing opening, the controller is made to receive a pull-out signal indicating the removal of the product; and upon receiving said pull-out signal, the controller sends out a drive signal to transfer a number of sheet products from the front of the stack into a presentation position, and if the controller receives a low-level signal indicating that the amount of sheet products remaining within the housing has been reduced to below a predetermined level, wherein one or more sheet products remain within the housing, the controller enters into a low-level mode in which the sending of the drive signal in response to the pull-out signal is disabled.

14. The method of claim 13, wherein the controller further activates an alarm signal when entering the low-level mode.

15. The method of claim 13, further comprising the step of pre-selecting the number of sheet products to be transferred into the presentation position via a user interface which is connected to the controller.

16. The method of claim 13, wherein:

upon detection of the operation of a user operable command element, the controller is made to receive a product request signal, and upon receiving said product request signal, the controller sends out a drive signal to transfer a second number of sheet products from the front of the stack into the presentation position.

17. The method of claim 16, further comprising the step of pre-selecting the second number of sheet products to be transferred into the presentation position via a user interface which is connected to the controller.

18. The method of claim 17, wherein the second number of sheet products is selected independent from the first number of sheet products.

19. The dispenser of claim 13, wherein the controller sends out a drive signal to the actuator in response to a product request signal irrespective of whether the controller is in the low-level mode.

20. The dispenser of claim 14, wherein the alarm signal is a visual and/or audible alarm signal.

* * * * *